US011575982B2

(12) United States Patent
Audi et al.

(10) Patent No.: US 11,575,982 B2
(45) Date of Patent: Feb. 7, 2023

(54) AUDIO SPEAKER COVER FOR ENHANCED AUDIO PERFORMANCE

(71) Applicant: OAKWOOD METAL FABRICATING CO., Dearborn, MI (US)

(72) Inventors: Richard Francois Audi, Dearborn, MI (US); Donald Scott Smith, Commerce, MI (US); Joel Matthew Cormier, Lathrup Village, MI (US); Michael Anthony Rossi, Grosse Ile, MI (US); Mark Steven Kunitz, Newport, MI (US)

(73) Assignee: OAKWOOD METAL FABRICATING CO., Dearborn, MI (US)

( * ) Notice: Subject to any disclaimer, the term of this patent is extended or adjusted under 35 U.S.C. 154(b) by 428 days.

(21) Appl. No.: 16/751,080

(22) Filed: Jan. 23, 2020

(65) Prior Publication Data

US 2021/0235174 A1 Jul. 29, 2021

(51) Int. Cl.
*H04R 1/02* (2006.01)
*H04R 1/32* (2006.01)

(52) U.S. Cl.
CPC ..... *H04R 1/023* (2013.01); *H04R 1/323* (2013.01); *H04R 2201/029* (2013.01)

(58) Field of Classification Search
CPC .. H04R 1/023; H04R 1/323; H04R 2201/029; H04R 29/001; H04R 1/1058; H04R 1/02
See application file for complete search history.

(56) References Cited

U.S. PATENT DOCUMENTS

| | | | | |
|---|---|---|---|---|
| 5,754,669 | A * | 5/1998 | Shiota | H04R 1/023 381/189 |
| 9,014,411 | B2 | 4/2015 | Rodgers | |
| 2005/0281429 | A1* | 12/2005 | Rivera | H04R 1/023 381/189 |
| 2007/0177754 | A1 | 8/2007 | Kemmerer | |
| 2007/0187173 | A1* | 8/2007 | Price | H04R 1/023 181/199 |
| 2007/0263878 | A1* | 11/2007 | Yu | H04R 1/26 381/73.1 |
| 2018/0315409 | A1* | 11/2018 | Matsuo | H04R 1/44 |
| 2019/0301727 | A1* | 10/2019 | Sieczkowski | G02B 6/0095 |

FOREIGN PATENT DOCUMENTS

| | | | | |
|---|---|---|---|---|
| CA | 2011619 C | | 1/1999 | |
| CN | 107948767 A | * | 4/2018 | H04R 1/02 |
| CN | 107948767 A | | 4/2018 | |
| DE | 10304550 A1 | * | 7/2004 | H04R 1/023 |

(Continued)

*Primary Examiner* — Angelica M McKinney
(74) *Attorney, Agent, or Firm* — Brooks Kushman P.C.

(57) ABSTRACT

An audio speaker cover with a central region and a peripheral region. The central region has a surface that faces an observer and a speaker cover body below the surface. The audio speaker cover body defines a plurality of apertures with lands between the apertures. The apertures have cylindrical walls that meet the surface orthogonally. Precisely engineered apertures permit minimal sound transmission loss and allow a high aperture density without sacrificing the ability of intervening lands in the audio speaker cover to protect an underlying speaker.

6 Claims, 9 Drawing Sheets

Columnar Aperture Array of Various Aperture Sizes

(56) References Cited

FOREIGN PATENT DOCUMENTS

| | | | | | | |
|---|---|---|---|---|---|---|
| DE | 202007010035 | U1 | * | 11/2007 | ..... | H04R 1/023 |
| GB | 2288513 | A | * | 10/1995 | ..... | H04R 1/023 |
| JP | H07225587 | A | | 8/1995 | | |
| JP | 2009527203 | A | * | 7/2009 | | |
| JP | 2018008645 | A | | 1/2018 | | |
| KR | 100313022 | B1 | | 11/2001 | | |
| TW | 201710329 | A | * | 3/2017 | ..... | B32B 27/36 |

* cited by examiner

Injection Molded Aperture Section

Woven Wire Image

Expanded Metal Image

Punched Aperture Top View

Laser Aperture Iso and Section Views

Laser Top View

Water Jet Cutting Progressive Sections

Chemical Etching Sheet Metal Section Before and After Etching

Single Sided Etched Aperture Sectional Image

Columnar Aperture Array of Various Aperture Sizes

Columnar Aperture Array Top View of Various Aperture Sizes

Audio Testing Setup

Audio Performance Test Results

Gardner Instrument Dart Test Setup

Gardner Instrument Dart Test Results

AUDIO SPEAKER COVER FOR ENHANCED AUDIO PERFORMANCE

TECHNICAL FIELD

The present disclosure relates to an audio speaker cover that exhibits superior strength with columnar apertures for enhanced audio performance.

BACKGROUND ART

Audio speaker covers have been manufactured for decades from a variety of materials including fabric, thermoplastics, thermosets, perforated metal, expanded metal, woven wire, and the like. Certain materials such as fabric may be thin and have a large open area percentage. This may be ideal for sound transmission. But these materials lack the ability to adequately protect the speaker assembly in environments where human contact and abuse is anticipated. Examples include home audio systems, electronic devices, computers, microphones, portable speakers, and transportation-related audio systems such as cars, trucks, boats, aircraft and the like.

In such applications, substantially rigid audio covers are deployed adjacent to the speaker itself to protect the fragile speaker cone and assembly from damage. Additionally, since these systems are in proximity to the audiophile, visual styling and aesthetics are also necessary in order to produce a cost-effective yet attractive means of protecting the speaker itself.

Speaker covers may be injection molded from thermoplastics. However, plastics have a lower strength to weight ratio compared to metal speaker covers and therefore require substantially more thickness than a metal cover to protect the speaker assembly. In order to mold the cover, a minimum of 0.5 degrees of draft must be added to the design of the molded hole in order to "demold" the cover without sticking to the mold and deforming the cover upon ejection from the mold. This draft condition may be from one direction as pictured in FIG. 1 or at a mid-plane between mold halves.

Metal speaker covers have historically offered superior sound transmission characteristics compared to plastic speaker covers due to their high strength to weight ratio. Metal audio covers can be produced from a variety of metals including woven metal wire and with sheets of metal which are subject to a variety of processes to create apertures for sound transmission. These sheet-based processes include metal expanding, punch perforating, laser cutting, water jet cutting, photochemical etching, and powdered metal laser sintering. Sheets of these materials with apertures are then converted in finished goods using traditional metal forming techniques combined with a variety of coating and finishing techniques. However, the finished speaker cover needs to be visually pleasing to the audiophile. The penalty for adding a cover is always the amount of sound transmission loss due to solid or the non-open area of the rigid speaker cover that protects the speaker.

The ideal speaker cover is both attractive and cost effective to manufacture along with providing adequate strength that withstands normal abuse and offers the lowest possible sound transmission loss. Metal speaker covers have traditionally offered the best balance of strength and lower levels of sound transmission loss than compared to injection molded speaker covers.

Current methods for making apertures in metal speaker covers generally fail to balance aesthetics, strength, and acoustic performance. Each technology lacks an essential element in that it creates apertures which are less than ideal for minimizing sound transmission loss while maintaining the strength to adequately protect the speaker from abuse. Known manufacturing techniques in the art of making speaker grills include use of woven wire, metal expanding, metal perforating, laser cutting, water jet cutting, photochemical etching and powdered metal sintering.

Woven wire is created by weaving individual strands of wire to create a wire mesh, much like the way cloth is woven to create fabrics. FIG. 2 is an image of a typical wire mesh. However, the material is expensive since wire must be manufactured and then woven into a mesh with ends that are prone to separation. Furthermore, the material has irregular apertures that are not ideal for acoustic performance.

Metal expanding techniques cost effectively produce apertures in rows by shearing and tearing the metal to create the apertures. FIG. 3 is an image of expanded metal. However, the expanding process often results in hardening and embrittlement of the metal which leaves the material susceptible to tearing. The hardening that occurs makes the material challenging to form complex shapes. Furthermore, the walls of the resulting apertures are rough and not parallel to one another and are therefore not ideal for sound transmission. However, this does produce an attractive surface with reasonable economics and acceptable acoustic performance.

Metal perforating using traditional stamping techniques is often used to produce an array of apertures in a sheet of metal. FIGS. 4A-4B are views of a "punched" aperture. As depicted, there is an initial deformation that occurs on the surface contacted by the punch. The walls that result from the punching operation are not parallel to one another. They have a rough surface that is "torn". The punch compresses a "slug" of material through the button which generates wasted material. The tapered aperture that results from this manufacturing process is not ideal for sound transmission. While a punched side surface may be aesthetically satisfactory, the slug exit usually has an unsightly burr which is generally hidden from view and is typically oriented toward the speaker assembly.

Laser cutting is also used to create apertures in metal speaker covers. Fiber or CO2 lasers can effectively burn and melt through the sheet metal to produce apertures. However, this process yields unsightly apertures, as shown in the FIGS. 5A-5B. The resulting walls of the aperture are irregular, and they are not parallel to one another. This condition is not desirable for acoustic performance. Furthermore, metal splatter is generated as the laser bursts through the material. Like punched metal, this melted metal splattered surface is typically hidden from the consumer, like the burr side of perforated or punched speaker covers.

Water jet cutting produces a tapered cut, like laser cutting without the metal splatter. Again, a tapered irregular wall results from the process, which is not ideal for strength and acoustic performance. To illustrate, FIG. 6 is a series of progressive sections of water jet cutting apertures through a material. Thus, water jet cutting is only suitable for producing large apertures with non-parallel walls. They are generally unsuitable, both visually and economically for audio covers.

Photochemical etching can also be used to produce apertures within a metal sheet. A resist layer is applied to a surface. Then that layer is selectively removed in areas where the apertures are required. FIG. 7 is a sectional view of a layer of sheet metal and a pre-applied resist layer before and after etching. The resist protects the metal surface not exposed to the etchant which "eats" into the metal. Resist and etchant may be applied to one or both sides of the metal. The etchant begins etching into unmasked surface as well beneath the area where the resist remains as depicted in FIG. 8. This method also produces walls which are both irregular and not parallel to one another, which is not ideal for acoustical performance.

Powdered metal sintering can produce a speaker cover with apertures whose walls are relatively parallel to one another. However, the resulting aperture walls and surface texture is poor and require secondary refinishing prior to the final surface treatment. The surface that results is not suitable for "Class A" applications. Furthermore, this method has proven to be cost prohibitive for most applications and is only suitable for rough proof of concept prototypes at this time.

SUMMARY

The disclosed product includes in some aspects an attractive audio speaker cover with superior strength and an array of precisely spaced columnar apertures that demonstrates superior audio performance compared to the prior art. Often, such audio speaker covers are embodied in the form of a grill.

Thin metal audio speaker covers having adequate strength with a large open area and apertures whose walls are smooth and straight are preferred for both audio performance and speaker cover strength. Apertures can be spaced closer together if the aperture walls are parallel to one another. This contrasts with prior art approaches in which apertures are irregular and have aperture walls that are not parallel to one another.

Straight walled apertures minimize the aperture to aperture spacing by maximizing the remaining material ("lands") available for speaker cover strength. Such interstitial material tends to protect the speaker from abuse.

The open areas available for sound transmission offer a theoretical maximum open area that minimizes sound transmission loss.

FIG. 10A depicts a single aperture of one speaker cover embodiment with a smooth walled parallel aperture. Noteworthy is that the intersection of an aperture wall with a speaker cover surface is predictably regular and orthogonal.

Aesthetically, columnar apertures result in a speaker cover surface that is substantially free of blemishes or deformation. Such characteristics favorably compare with prior art approaches used to create apertures in metal for sound transmission.

In summary, the innovation produced superior audio performance in relation to conventional approaches and maintained adequate strength to protect the fragile speaker cone.

The above advantage and other advantages and features of the present disclosure will be readily apparent from the following detailed description of the preferred embodiments when taken in connection with the accompanying drawings.

DETAILED DESCRIPTION

Figure 1:
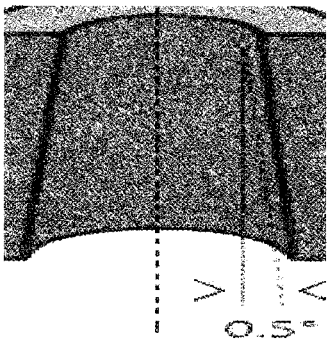
FIG. 1 depicts an injection molded aperture section.
Figure 2:
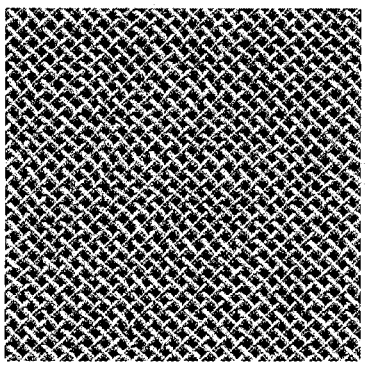
FIG. 2 is a woven wire image.
Figure 3:
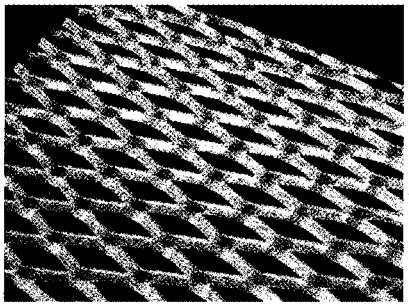
FIG. 3 is an expanded metal image.
Figure 4A:
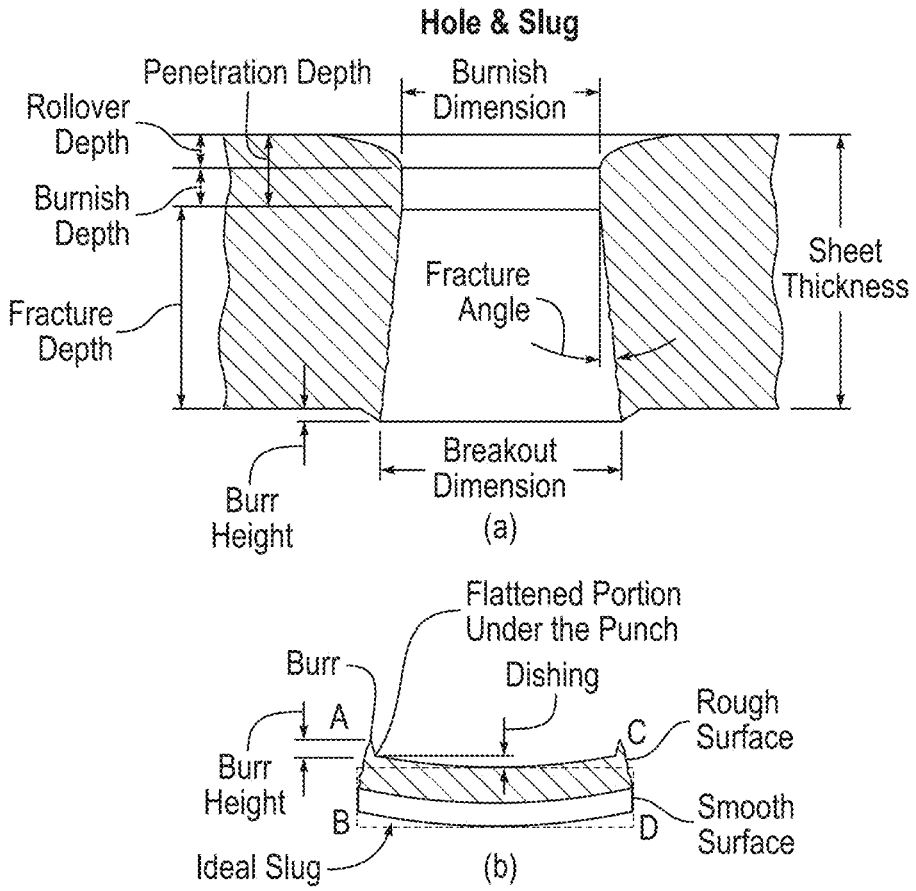
FIG. 4A is a punched aperture section.
Figure 4B:
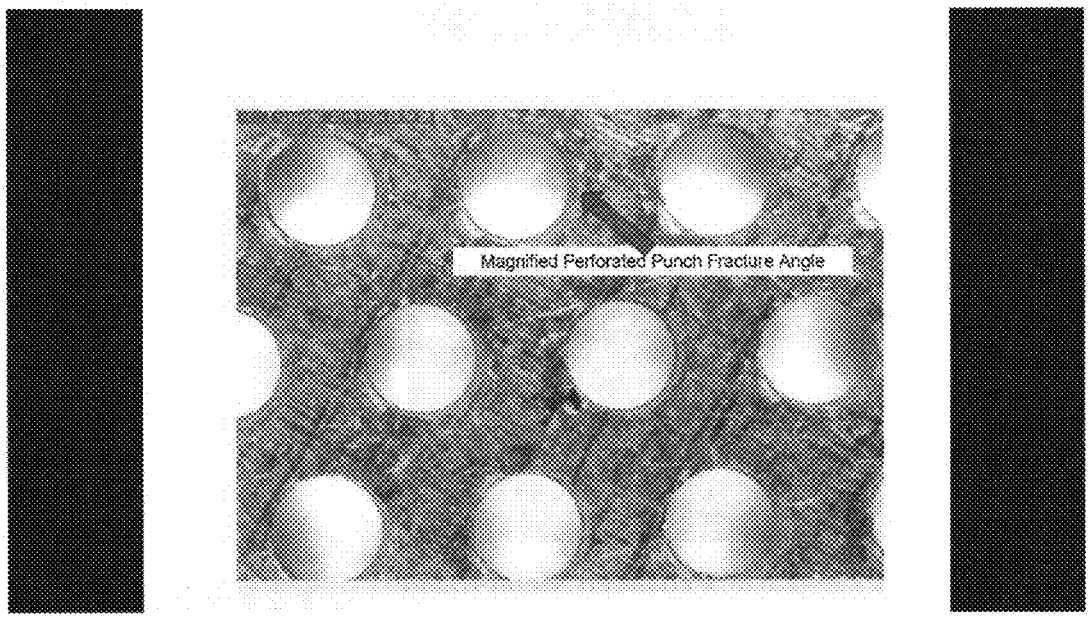
FIG. 4B is a top view of a punched aperture.
Figure 5A:
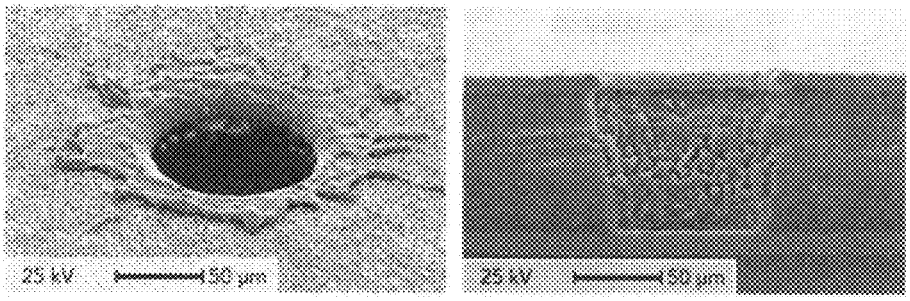
FIG. 5A is an isometric view of a laser aperture and a section view thereof.
Figure 5B:
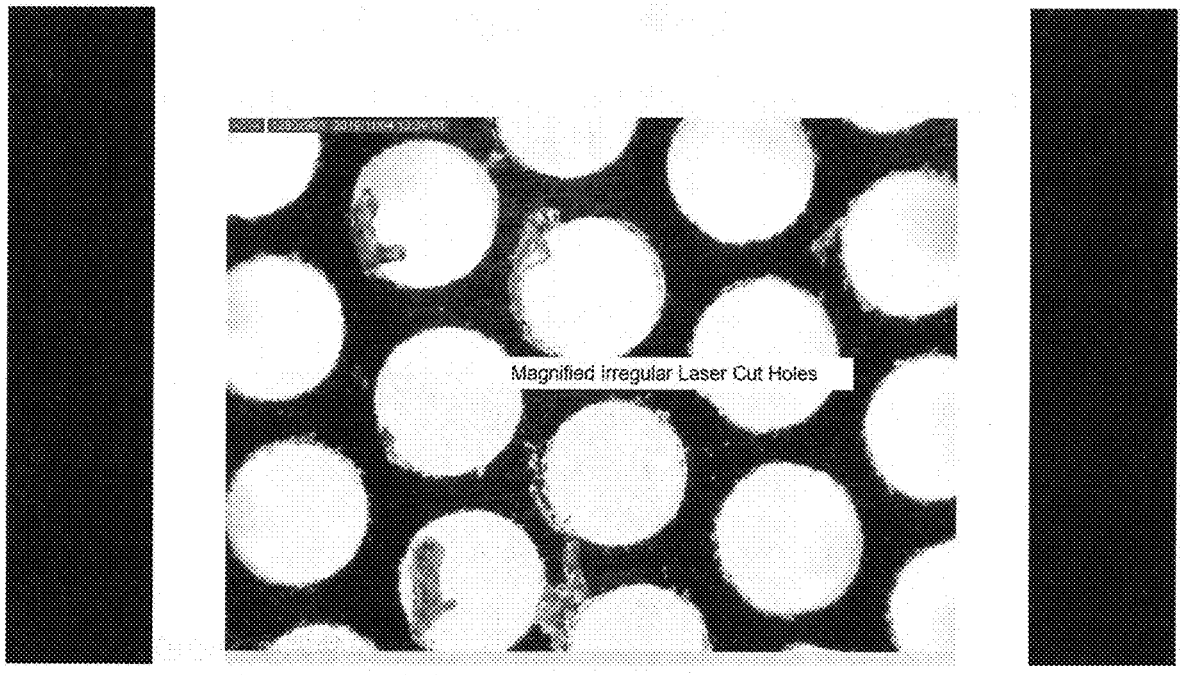
FIG. 5B is a top view of an aperture made by a laser.
Figure 6:
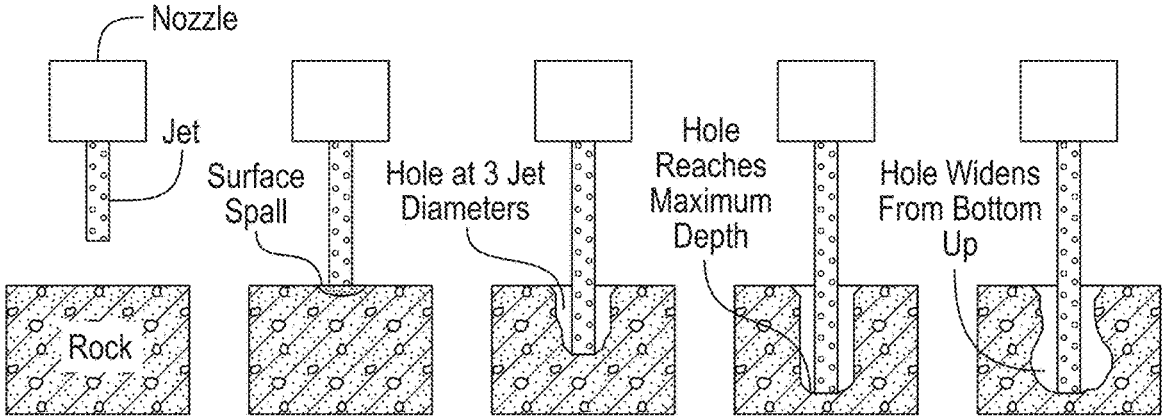
FIG. 6 illustrates sections of a water jet cutting technique.
Figure 7:
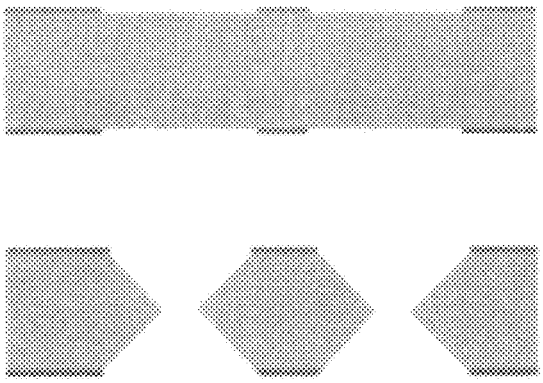
FIG. 7 shows a chemical etching sheet metal section before and after etching.
Figure 8:
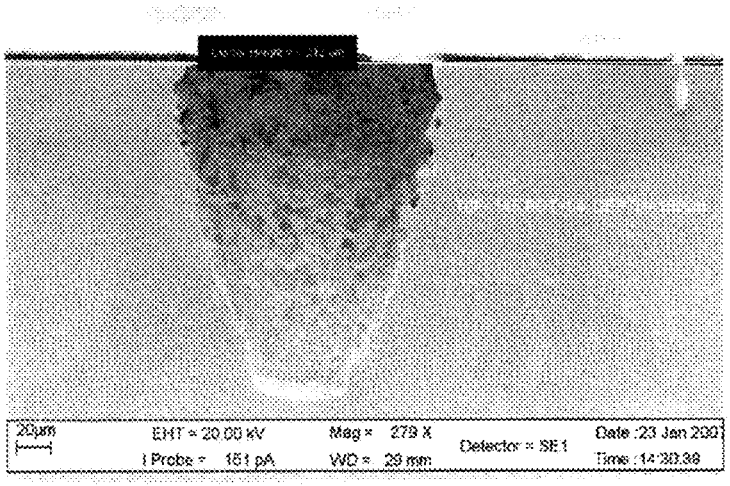
FIG. 8 is an image of a single sided etched aperture.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As those of ordinary skill in the art will understand, various features of the present invention as illustrated and described with reference to any one of the Figures may be combined with features illustrated in one or more other Figures to produce embodiments of the present disclosure that are not explicitly illustrated or described. The combinations of features illustrated provide representative embodiments for typical applications. However, various combinations and modifications of the features consistent with the teachings of the present disclosure may be desired for particular applications or implementations.

Turning first to FIGS. 9A, 9B, 10A and 10B, there are depicted various aspects of representative embodiments of an audio speaker cover 10 with a central region 12 and a peripheral region 14. In some embodiments, the central region has a generally planar, concave or convex surface 16 and an audio speaker cover body 18 below the surface.

In a preferred embodiment, the audio speaker cover body 18 defines a plurality of apertures 20. Lands 22 lie between at least some of the apertures 20. The apertures 20 have precisely formed cylindrical walls 24 that meet the generally speaker cover surface 16 orthogonally.

Figure 10A:
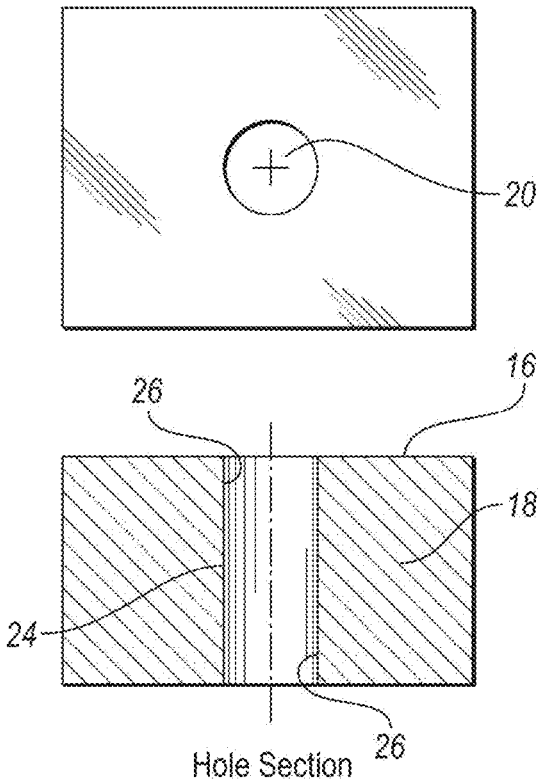
FIG. 10A is a sectional and top plan elevational view of a representative aperture defined in an audio speaker cover with orthogonality at the inner and outer surfaces thereof.
Figure 10B:
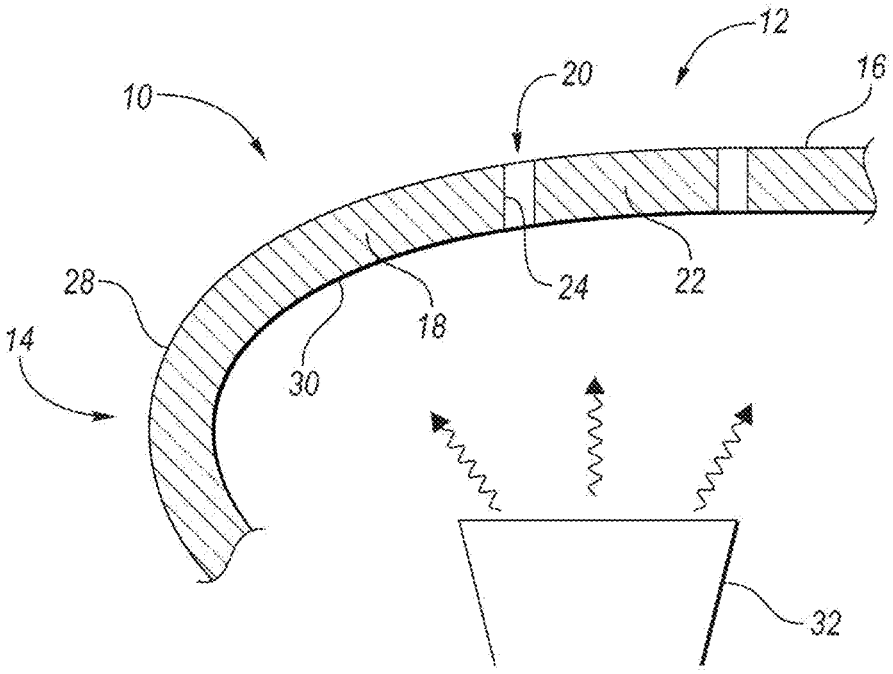
FIG. 10B is a fragmented representative cross section through a peripheral region and a central planar region of an audio speaker cover.

With primary reference to FIG. 10B, the central region 12 of the audio speaker cover 10 can be imagined to occupy an area (C), the apertures 20 have a total area (A) and the lands have a total area (L). It can be seen that $$C=A+L, \text{ and}$$

A=30 to 85 percent of C.

Without being bound by a particular theory, it is believed that the relatively high percentage of aperture area (A) in relation to audio speaker cover (C) is enabled by precisely formed apertures 20. At least some of the apertures 20 have cylindrical walls 24 that have a uniform diameter along their depth. Further, at least some of the apertures 20 have shoulder portions 26 (FIG. 10A) that are substantially square, within generally acceptable manufacturing tolerances.

In more detail (see, e.g., FIG. 10B), the audio speaker cover 10 has an outer surface 28 that faces an observer and an inner surface 30 that faces a speaker 32. At least some of the apertures 20 in the central region 16 have a total area (A) at the outer surface 28 that equals the total area (A) at the inner surface. 30.

As noted earlier, in the audio speaker cover 10, at least some of the apertures 20 have a cylindrical wall 24 that has shoulder portions 26 that lie orthogonally at the outer surface 28 and inner surface 30.

At least some cylindrical walls 24 are smooth, such that they offer minimal interference to sound waves that pass from the speaker 32 to the outer surface 28 of the audio speaker cover 10.

Lands 22 (FIG. 10B) between the apertures 20 occupy between 15 and 70 percent of the area (C) of the central region 16 of the audio speaker cover. Without being bound by a particular theory, it is believed that the area of lands is relatively low in comparison to prior art solutions. This is likely due to precisely formed apertures with square shoulders between which there is minimal deformation or debris, unlike conventional aperture-forming techniques. As a result, the lands present minimal obstruction to sound waves that pass through the audio speaker cover (see, FIGS. 11-12). Some audio test results (FIGS. 11-12) confirm that sound distortion is minimal and there is little sound transmission loss.

Figure 10C:
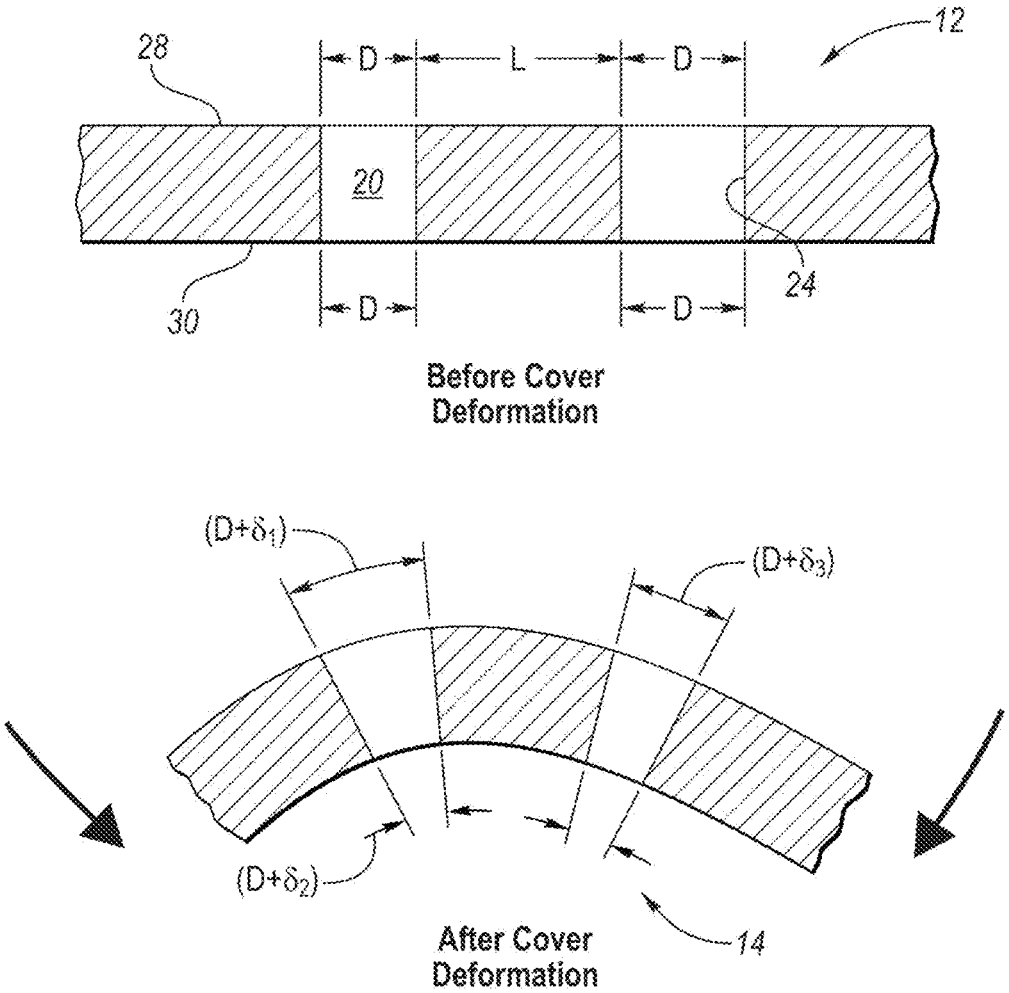
FIG. 10C is a fragmented sectional view of a curved peripheral region of an audio speaker cover.

It will be appreciated that curvature of the audio speaker cover 10 during forming may have a distorting effect on otherwise perfectly cylindrical walls 24 and apertures 20 that are circular at the outer grill surface 28 and inner grill surface 30. See, e.g., FIG. 10C. Consider the peripheral region 14 of the audio speaker cover 10. That region has an outer surface 28 and an inner surface 30. However, the apertures 20 of the central region 12 have an average diameter (D) that is uniform across the cylindrical walls 24 of the apertures 20.

It can be seen (FIG. 10C) that the apertures 20 of the peripheral region 14 have an average diameter ($D+\delta 1$) at the outer surface 28 and ($D-\delta 2$) at the inner surface 30. But at least some of the apertures 20 are cylindrical in the substantially undistorted central region 16, through which most of the sound waves are transmitted.

The apertures 20 of the peripheral region 14 have walls 24 that remain smooth after deformation of a blank that forms the central region 16 and the peripheral region 14 of the speaker gill cover 10 so as to present minimal disturbance to sound waves that pass therethrough.

Figure 9A:
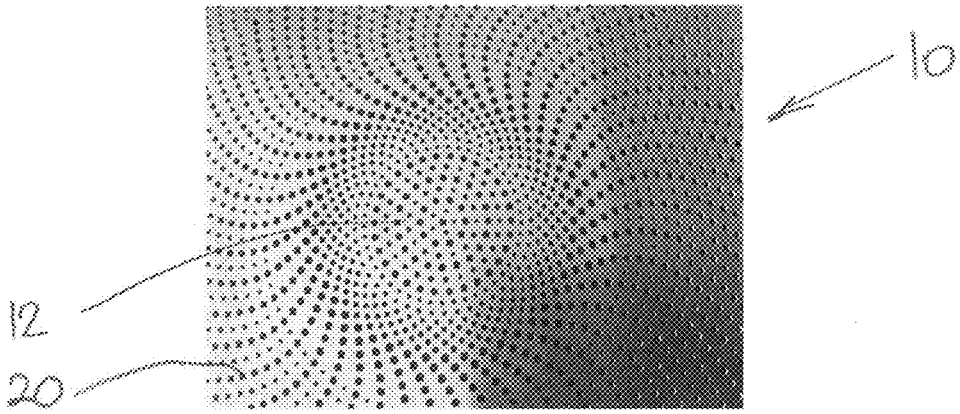
FIG. 9A is a front view of an audio speaker cover with a patterned array of apertures of various sizes. Preferably, aperture density for a given aperture size per unit speaker cover surface area is greater than in prior practices.
Figure 9B:
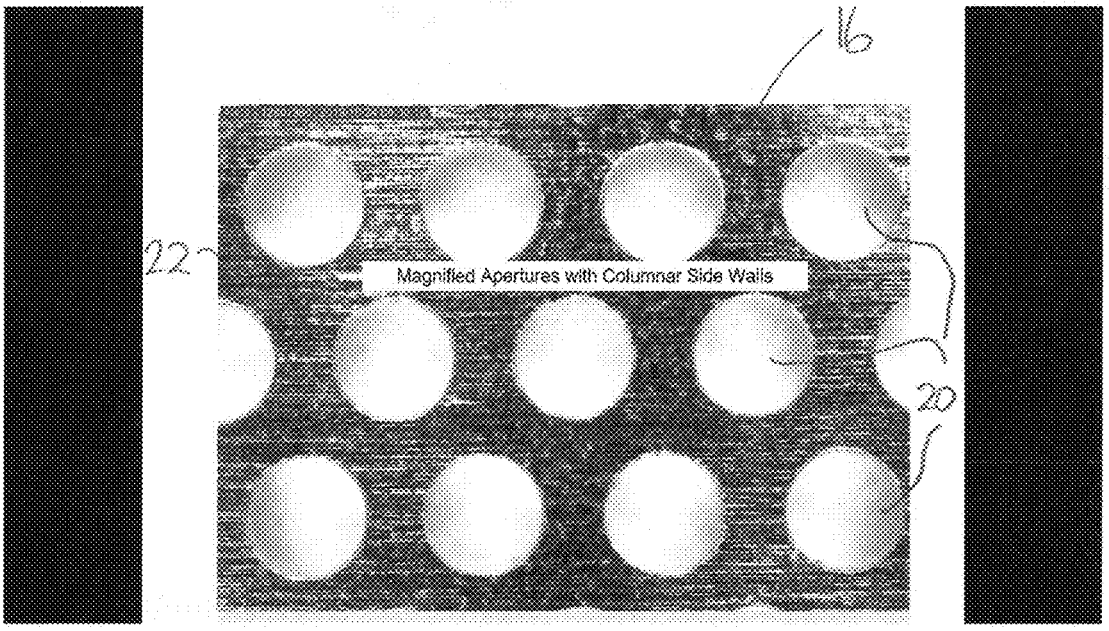
FIG. 9B is an enlarged top view of a linear array of columnar apertures.

FIG. 9A shows a central area of speaker cover in which the apertures 20 have a range of diameters at the outer surface 28. In such cases, the apertures proximate one region of the audio speaker cover have a diameter that differs from the diameter of apertures in another region of the audio speaker cover.

In alternate embodiments, at least some of the apertures 20 are non-circular. In such cases, the non-circular apertures have a shape selected from the group consisting of oval, ovate, ovoid, elliptical, egg-shaped and combinations thereof.

As mentioned above, it will be appreciated that in some embodiments, the central region 12 may be convex or concave, bulging outwardly or inwardly in relation to a speaker 32.

Preferably, the audio speaker cover 10 has an inner surface 30 and outer surface 28 that is substantially free of deformation or blemish.

Tests have shown that the sound transmission loss following passage of sound waves through the audio speaker cover over a frequency range of 60-15,000 Hz is less than about 5 dBm.

To manufacture speaker covers with apertures having cylindrical walls and square shoulders, forming methods are followed that avoid problems created by such conventional approaches as injection molding, woven wire, expanded metal, punching, laser forming, and chemical etching.

To make the disclosed speaker covers in volume, the skilled artisan may proceed by securing one or more blanks in relation to each other or to a holder, each blank having an inner surface and an outer surface. Apertures are then formed in the one or more blanks so that cylindrical walls define one or more apertures. The cylindrical walls meet at least some of the blank inner surfaces and outer surfaces orthogonally, often without the need for a de-burring step.

In some embodiments, the audio speaker cover is made from a material selected from the group consisting of stainless steel, aluminum, low carbon steel, titanium, wood, plastics, composites including laminated layers and composites of one or more dissimilar materials.

Experimental Data

Experiments have been undertaken to confirm superior audio performance and reduced transmission loss following the suggested practices. Minimizing the sound transmission loss and distortion through a speaker cover is key to the performance of an audio system. Any material used to protect a fragile speaker cone from abuse will likely result in some degree of sound transmission loss at both low and high frequencies. It would be desirable to minimize that loss.

Figure 11:
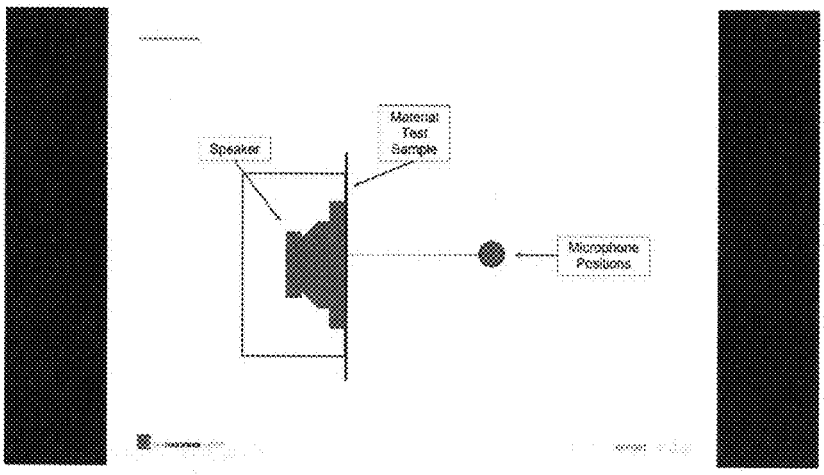
FIG. 11 illustrates an audio testing setup.

FIG. 11 shows a test setup to compare the sound transmission response of two materials compared to air as a baseline. In this test setup, a speaker and a microphone are located 1 m from one another, representing an average distance from an automobile occupant. An initial baseline frequency sweep from 60-15,000 Hz) was measured with only air between the speaker and microphone located in an anechoic chamber. Higher end frequencies are more easily distorted than low end frequencies.

Figure 12:
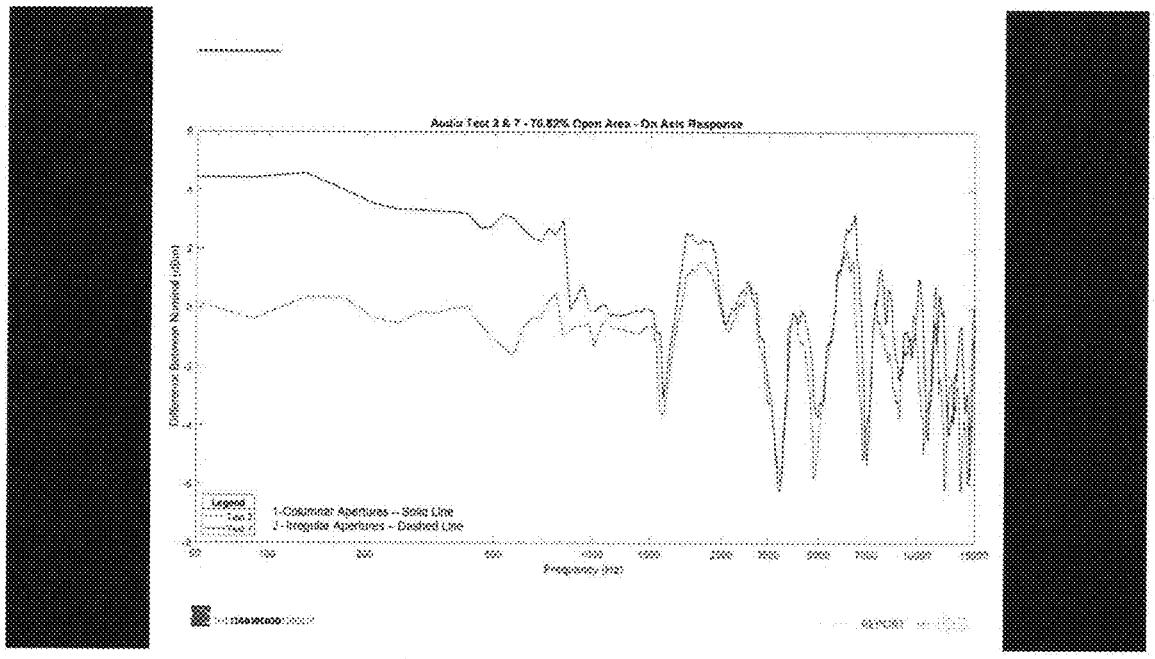
FIG. 12 includes audio performance test results.

Two cover materials (1—columnar apertures; 2—irregular apertures) were interposed between the speaker and microphone and run through the same frequency sweep as depicted in FIG. 12. The average aperture size of both materials was identical.

Test results showed that the columnar apertures result in generally less sound transmission loss when compared to the irregular apertures at both low and high frequencies throughout the sweep. Lower levels of sound transmission loss mean superior audio performance.

Figure 13:
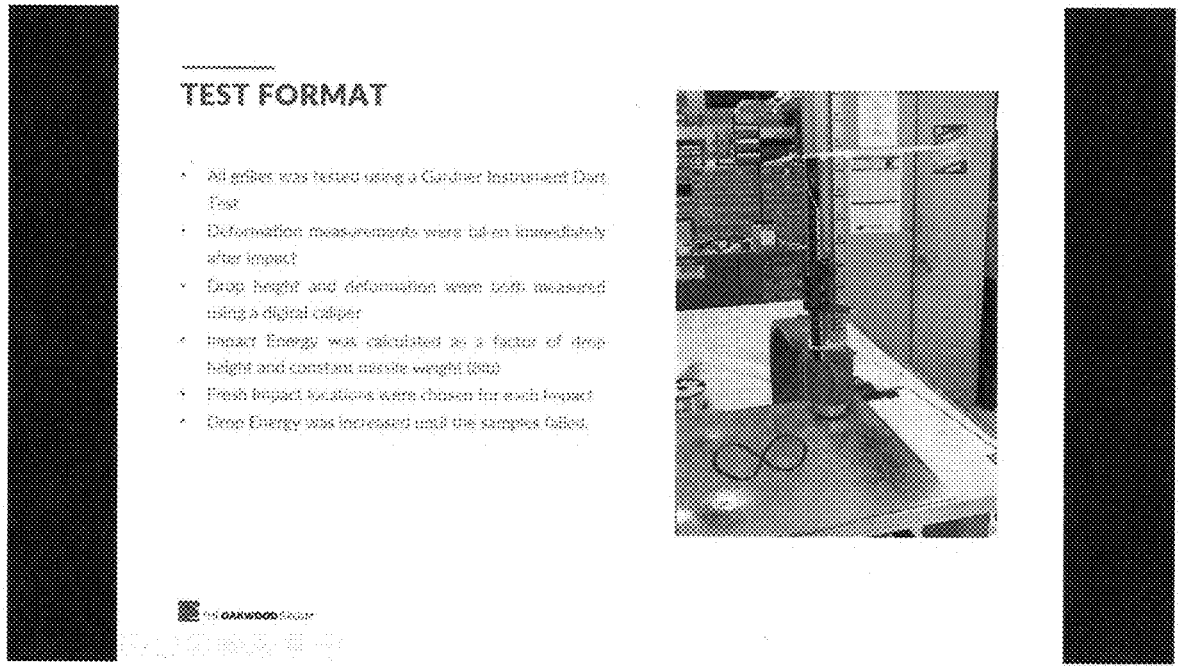
FIG. 13 describes a representative Gardner Instrument Dart test setup.
Figure 14:
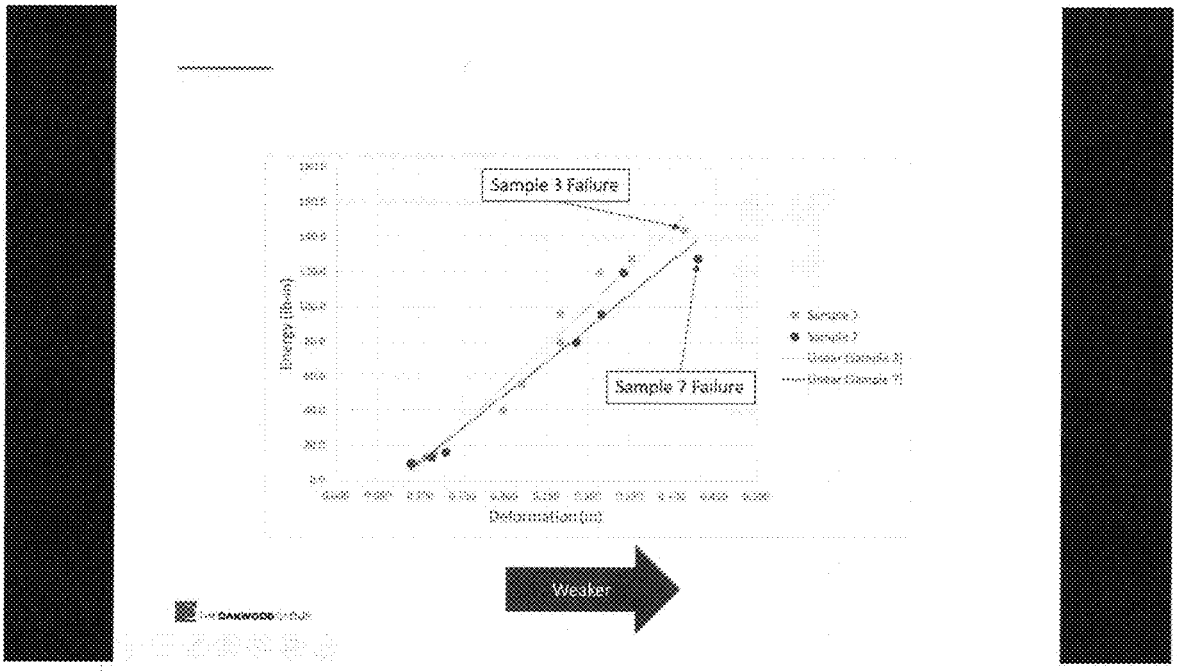
FIG. 14 portrays some representative Gardner Instrument Dart test results.

In summary, the innovation produced superior audio performance in relation to conventional approaches and maintained adequate strength to protect the fragile speaker cone. See, e.g., FIGS. 13-14.

In some cases, it may be useful to deploy means for attaching the audio speaker cover to a mounting surface. If so, the means for attaching may include tabs and/or snap features extending from the peripheral region toward a speaker cone. Preferably, the means for attaching lie generally parallel to an imaginary line that is perpendicular to the central region.

If desired, the audio speaker cover may have lands that are devoid of holes for accommodating additional layers of printed, machined, deposited, painted or drilled material or logos or coatings on an outer surface of the audio speaker cover for aesthetic purposes to achieve a desired appearance or texture or indicate a source or origin of the audio speaker cover. For example, badging may indicate the source or origin of the audio system.

Further embodiments of the audio speaker cover may have means for attaching a low density masking material or foam to an underside of the audio speaker grill for hiding internal speaker components.

While the best mode has been described in detail, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

TABLE OF

REFERENCE NUMBERS

| Reference No. | Component |
|---|---|
| 10 | Audio Speaker Cover |
| 12 | Central Region |
| 14 | Peripheral Region |
| 16 | Planar Surface |
| 18 | Audio Speaker Cover Body |
| 20 | Apertures |
| 22 | Lands |

TABLE OF-continued

REFERENCE NUMBERS

| Reference No. | Component |
|---|---|
| 24 | Cylindrical Walls |
| 26 | Shoulder Portions |
| 28 | Outer Surface |
| 30 | Inner Surface |
| 32 | Audio Speaker |

What is claimed is:

1. An audio speaker cover with a central region and a peripheral region, the central region having an area (C), an outer surface; and an audio speaker cover body below the outer surface, the audio speaker cover body defining a plurality of apertures with lands between at least some of the apertures, the apertures having cylindrical walls that meet the outer surface orthogonally, wherein the outer surface faces an observer and below the outer surface lies an inner surface that faces a speaker, at least some of the apertures in the central region having an area (A) at the outer surface that equals an area (A) at the inner surface, wherein the apertures occupy between 30 and 85 percent of the area (C) of the central region of the audio speaker cover at the inner surface and the outer surface.

2. The audio speaker cover of claim 1, wherein the lands occupy between 15 and 70 percent of the area (C) of the central region of the audio speaker cover.

3. The audio speaker cover of claim 1, wherein:

the peripheral region of the audio speaker cover has an outer surface and an inner surface, the apertures of the central region have an average diameter (D) that is uniform across the cylindrical walls of the apertures;

the apertures of the peripheral region have an average diameter (D+δ) at the outer surface and (D−δ) at the inner surface; and the apertures of the peripheral region having walls that remain smooth after deformation of a blank that is formed to create the central region and the peripheral region of the audio speaker cover, thereby presenting minimal disturbance to sound waves that pass therethrough.

4. The audio speaker cover of claim 1, wherein at least some of the plurality of apertures are non-circular.

5. The audio speaker cover of claim 4, wherein the non-circular apertures have a shape selected from the group consisting of oval, ovate, ovoid, elliptical, egg-shaped and combinations thereof.

6. The audio speaker cover of claim 1, wherein the sound transmission loss following passage of sound waves through the audio speaker cover over a frequency range of 60-15,000 Hz is less than about 5 dBm.

* * * * *